US008978371B2

(12) United States Patent
Kawamoto

(10) Patent No.: US 8,978,371 B2
(45) Date of Patent: Mar. 17, 2015

(54) COOLING ADAPTER

(75) Inventor: Naoya Kawamoto, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 765 days.

(21) Appl. No.: 13/018,794

(22) Filed: Feb. 1, 2011

(65) Prior Publication Data

US 2011/0185716 A1 Aug. 4, 2011

(30) Foreign Application Priority Data

Feb. 1, 2010 (JP) ..... 2010-020424

(51) Int. Cl.
*F01N 3/02* (2006.01)

(52) U.S. Cl.
CPC ..... *F01N 3/02* (2013.01)
USPC ..... 60/321; 60/320

(58) Field of Classification Search
USPC ..... 60/272–324; 123/41.01–41.85
See application file for complete search history.

(56) References Cited

U.S. PATENT DOCUMENTS 3,729,937 A * 5/1973 Haddad ..... 60/298
7,287,494 B2 * 10/2007 Buck ..... 123/41.01

FOREIGN PATENT DOCUMENTS

JP 6415718 U 1/1989
JP 11049096 * 2/1999
JP 11049096 A * 2/1999
JP 11049096 A 2/1999

* cited by examiner

*Primary Examiner* — Thomas Denion
*Assistant Examiner* — Kelsey Stanek
(74) *Attorney, Agent, or Firm* — Gifford, Krass, Sprinkle, Anderson & Citkowski, P.C.

(57) ABSTRACT

There is provided a cooling adapter provided between a cylinder head of an internal combustion engine and an exhaust pipe of the internal combustion engine in such a manner as to connect the cylinder head and the exhaust pipe to each other. This cooling adapter is equipped with a plurality of exhaust passages provided in parallel with one another to cause an exhaust gas from the cylinder head to flow to the exhaust pipe, a water jacket formed around an entirety of the respective exhaust passages and among the respective exhaust passages to cause a cooling liquid to flow to exchange heat with the exhaust gas flowing through the plurality of the exhaust passages, an inlet portion configured to cause the cooling liquid to flow into the water jacket, and an outlet portion configured to cause the cooling liquid to flow out from inside the water jacket. The inlet portion is so provided as to open to the water jacket at a position close to the cylinder head and corresponding to a gap between adjacent ones of the exhaust passages.

7 Claims, 4 Drawing Sheets

COOLING ADAPTER

CROSS-REFERENCE TO RELATED APPLICATIONS

This application claims priority to Japanese Patent Application No. 2010-020424 filed on Feb. 1, 2010, which is incorporated herein by reference in its entirety including the specification, drawings and abstract.

BACKGROUND OF THE INVENTION

1. Field of the Invention

The invention relates to a cooling adapter.

2. Description of the Related Art

In an internal combustion engine, with a view to restraining the temperature of a catalyst provided in an exhaust system thereof from rising excessively, it is considered to cool an exhaust gas in the engine by a cooling liquid. In order to realize this cooling of the exhaust gas, as disclosed in, for example, Japanese Patent Application Publication No. 11-49096 (JP-A-11-49096), it is proposed to provide a cooling adapter for exchanging heat between the exhaust gas in the internal combustion engine and the cooling liquid between a cylinder head of the internal combustion engine and an exhaust manifold of the internal combustion engine.

This cooling adapter is so provided between the cylinder head of the internal combustion engine and the exhaust manifold of the internal combustion engine as to connect them together. The cooling adapter is equipped with a plurality of exhaust passages provided in parallel with one another to cause an exhaust gas flowing out from the cylinder head to flow to the exhaust manifold, and a water jacket for causing to flow the cooling liquid that exchanges heat with the exhaust gas flowing through the plurality of the exhaust passages. This water jacket is formed around the entirety of the respective exhaust passages and among the respective exhaust passages. Further, the cooling adapter is also equipped with an inlet portion configured to cause the cooling liquid to flow into the water jacket, and an outlet portion configured to cause the cooling liquid in the aforementioned water jacket to flow out to the outside.

In the aforementioned cooling adapter, the cooling liquid is caused to flow into the water jacket from the aforementioned inlet portion, and the cooling liquid in the water jacket is caused to flow out from the outlet portion. The cooling liquid thereby flows in the water jacket. Then, when the cooling liquid is caused to flow into the water jacket of the cooling adapter while the exhaust gas in the internal combustion engine flows from the cylinder head to the exhaust manifold via the exhaust passages of the cooling adapter, heat is exchanged between the cooling liquid and the exhaust gas flowing through the aforementioned exhaust passages, and the exhaust gas cooled through this heat exchange flows to the exhaust manifold. Accordingly, by providing this cooling adapter, the exhaust gas cooled by the cooling adapter can be sent to a catalyst provided in an exhaust system of the internal combustion engine.

By providing the cooling adapter as described above, the exhaust gas cooled by the cooling adapter can be sent to the catalyst provided in the exhaust system of the internal combustion engine, but the following problem arises inevitably.

That is, that region of the cylinder head of the internal combustion engine on which the cooling adapter is mounted (that region of the cylinder head which is located on an exhaust outlet side) reaches a high temperature due to the heat of the exhaust gas and becomes likely to thermally expand.

The cooling adapter must be formed thickly to be able to cope with a stress acting on the cooling adapter as a result of this thermal expansion. Furthermore, as a result of the aforementioned thermal expansion in that region of the cylinder head which is located on the exhaust outlet side, the exhaust gas is likely to leak from a gap between mating faces of the cylinder head and the cooling adapter. Therefore, in order to suppress this leakage, it is necessary to take a measure such as the provision of a plurality of gaskets between the mating faces or the like.

Further, in the aforementioned cooling adapter, since the plurality of the exhaust passages are provided in parallel with one another, the cooling liquid in the water jacket is unlikely to flow into regions among the plurality of the exhaust passages. As a result, heat is unlikely to be exchanged between the cooling liquid and the exhaust gas in the regions among the plurality of the exhaust passages in the water jacket, and the efficiency of cooling the exhaust gas by the cooling adapter decreases correspondingly.

SUMMARY OF THE INVENTION

The invention has been made in consideration of these circumstances, and provides a cooling adapter capable of suppressing thermal expansion of a cylinder head of an internal combustion engine and reduction in the efficiency of cooling exhaust gas.

Thus, according to one aspect of the invention, there is provided a cooling adapter provided between a cylinder head of an internal combustion engine and an exhaust pipe of the internal combustion engine in such a manner as to connect the cylinder head and the exhaust pipe to each other. This cooling adapter is equipped with a plurality of exhaust passages provided in parallel with one another to cause an exhaust gas from the cylinder head to flow to the exhaust pipe, a water jacket formed around an entirety of the respective exhaust passages and among the respective exhaust passages to cause a cooling liquid to flow to exchange heat with the exhaust gas flowing through the plurality of the exhaust passages, an inlet portion configured to cause the cooling liquid to flow into the water jacket, and an outlet portion configured to cause the cooling liquid to flow out from inside the water jacket. The inlet portion is so provided as to open to the water jacket at a position close to the cylinder head and corresponding to a gap between adjacent ones of the exhaust passages.

According to the cooling adapter as described above, the exhaust gas from the cylinder head of the internal combustion engine is caused to flow to the exhaust pipe via the plurality of the exhaust passages provided in the cooling adapter in parallel with one another. On the other hand, when the cooling liquid is caused to flow into the water jacket of the cooling adapter from the inlet portion and the cooling liquid in the water jacket is caused to flow out to the outside from the outlet portion, the cooling liquid flows through the water jacket, and heat is exchanged between the cooling liquid and the exhaust gas flowing through the aforementioned exhaust passages. The exhaust gas flowing through the aforementioned exhaust passages is cooled through this heat exchange, and the cooled exhaust gas is caused to flow to the exhaust pipe.

It should be noted herein that the aforementioned inlet portion is so provided as to open to the water jacket at the position close to the cylinder head. Therefore, much of the low-temperature cooling liquid that has flowed into the water jacket from the inlet portion flows through the vicinity of that region of the cylinder head which is located on an exhaust outlet side in the water jacket, and efficiently absorbs the heat in that region. In other words, that region of the cylinder head which is located on the exhaust outlet side and likely to thermally expand is efficiently cooled by the cooling liquid that has flowed into the water jacket from the inlet portion of the cooling adapter. In this manner, that region of the cylinder head of the internal combustion engine which is located on the exhaust outlet side can be efficiently cooled. Therefore, the thermal expansion in that region can be suppressed.

Further, the aforementioned inlet portion is so provided as to open at the position corresponding to the gap between the adjacent ones of the exhaust passages. Therefore, the low-temperature cooling liquid that has flowed into the water jacket from the inlet portion is likely to flow into that region of the water jacket which is located between the adjacent ones of the exhaust passages. In this manner, the cooling liquid flows through that region of the water jacket which is located between the adjacent ones of the exhaust passages. Therefore, heat is not unlikely to be exchanged between the cooling liquid and the exhaust gas flowing in the exhaust passages. Accordingly, heat is unlikely to be exchanged between the cooling liquid and the exhaust gas in that region of the water jacket which is located between the adjacent ones of the exhaust passages, and the efficiency of cooling the exhaust gas in the cooling adapter can be restrained correspondingly from decreasing.

In the cooling adapter with the plurality of the exhaust passages provided in parallel with one another, there is a space portion for causing the cooling liquid to flow between the adjacent ones of the exhaust passages in the water jacket. Therefore, the geometric moment of inertia of that region of the cooling adapter which corresponds to the space portion is small. As a result, the amount of deformation through a bending moment in that region is likely to be large.

Thus, in the cooling adapter, it is also preferable that the inlet portion have a thick portion formed therearound for fixing a joint, and that the inlet portion be provided such that the thick portion is so located as to correspond to the space portion between the adjacent ones of the exhaust passages in the water jacket. In that case, the inlet portion is provided such that the thick portion formed around the inlet portion to fix the joint is so located as to correspond to the aforementioned space portion. Therefore, the geometric moment of inertia of that region of the cooling adapter which corresponds to the aforementioned space portion is large, and the amount of deformation by a bending moment in that region can be held small.

Further, it is also preferable that the inlet portion be provided on one side in a direction in which the plurality of the exhaust passages are arranged, and that the outlet portion be provided on the other side. In that case, the cooling liquid in the water jacket is likely to flow from one side to the other side in the direction in which the plurality of the exhaust passages are arranged. Therefore, the cooling liquid is less likely to flow into that region of the water jacket which is located between the adjacent ones of the exhaust passages. However, the aforementioned input portion is so provided as to open at the position corresponding to the gap between the adjacent ones of the exhaust passages. Therefore, the cooling liquid is not unlikely to flow into that region of the water jacket which is located between the adjacent ones of the exhaust passages as described above, and the efficiency of cooling exhaust gas in the cooling adapter can be restrained from decreasing as a result.

In the cooling adapter, the air that has entered the water jacket is likely to accumulate in an upper portion in the water jacket. It is preferable to swiftly discharge this air to the outside from the outlet portion, from the standpoint of efficiently exchanging heat between the cooling liquid flowing through the water jacket and the exhaust gas passing through the exhaust passages. Thus, in the cooling adapter, it is also preferable that the inlet portion be provided below the exhaust passages, and that the outlet portion be provided above the exhaust passages and so open as to connect to an uppermost portion of the water jacket.

According to the cooling adapter as described above, the cooling liquid flows into the water jacket from the inlet portion that is provided below the cooling adapter (below the exhaust passages), and the cooling liquid in the water jacket flows out from the outlet portion that is provided above the cooling adapter (above the exhaust passages) and so opens as to connect to the uppermost portion of the water jacket. Thus, even when the air accumulates in the upper portion in the water jacket as described above, it is possible to swiftly discharge the air from the outlet portion to the outside through the flow of the aforementioned cooling liquid.

Further, in the cooling adapter, it is also preferable that the outlet portion be so provided as to open to the water jacket on a more distal end side than that one of the plurality of the exhaust passages which is located at the other end in the direction in which the exhaust passages are arranged. In the case of this cooling adapter, the outlet portion is so provided as to open to the water jacket on the more distal end side than that one of the plurality of the exhaust passages which is located at the other end in the direction in which the exhaust passages are arranged, and the cooling liquid in the water jacket can be caused to flow out to the outside from the outlet portion. Accordingly, the flow of the cooling liquid to the outside can be formed in a region corresponding to the aforementioned end side in the upper portion inside the water jacket, namely, a region where air is likely to accumulate. As a result, the air can be restrained from accumulating in that region.

BRIEF DESCRIPTION OF THE DRAWINGS

The features, advantages, and technical and industrial significance of this invention will be described in the following detailed description of an example embodiment of the invention with reference to the accompanying drawings, in which like numerals denote like elements, and wherein.

DETAILED DESCRIPTION OF EMBODIMENT

Figure 1:
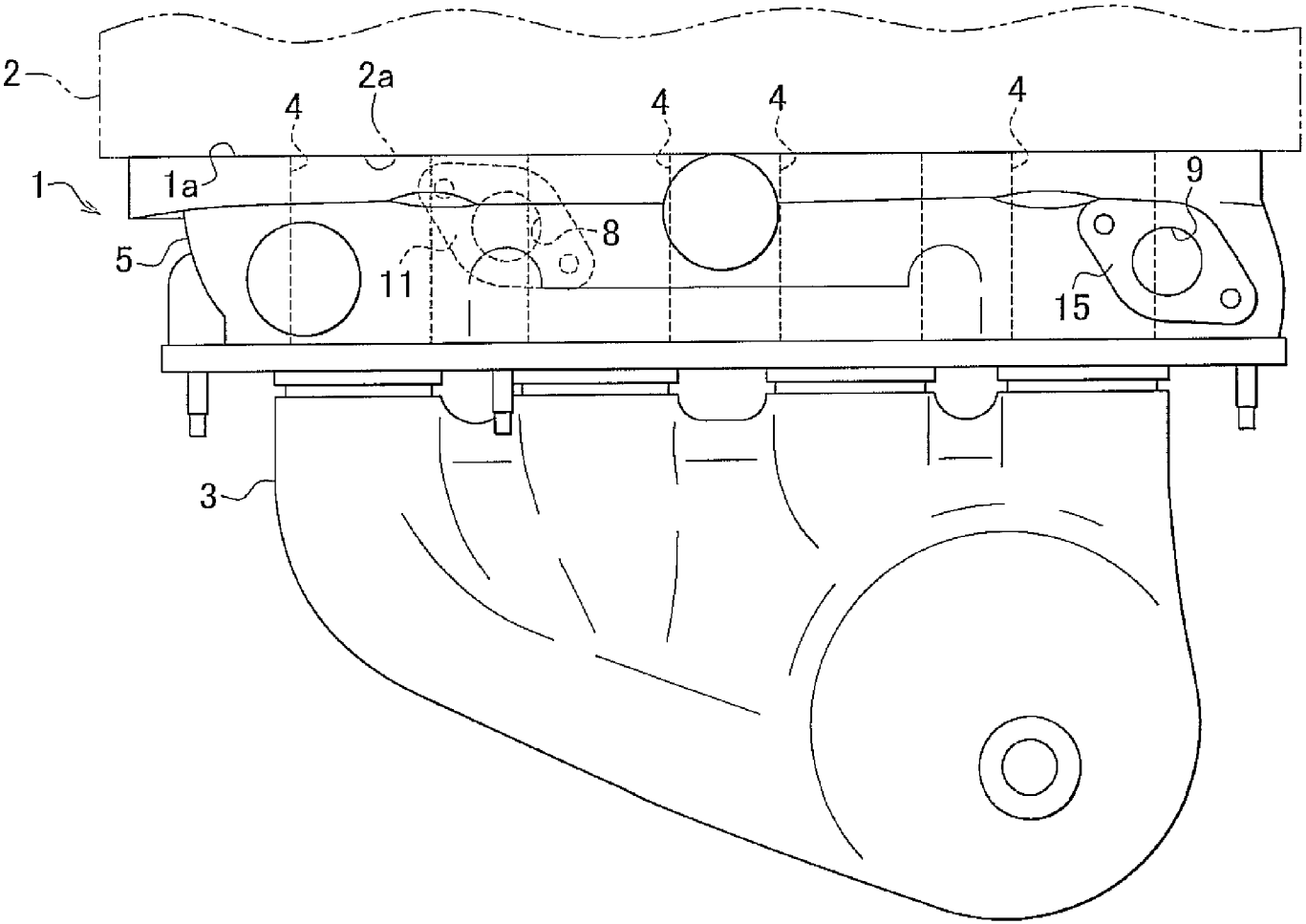
FIG. 1 is a plan view showing a cooling adapter according to this embodiment of the invention.

One embodiment as a concrete example of the invention will be described hereinafter with reference to FIGS. 1 to 3. As shown in FIG. 1, a cooling adapter 1 is provided between a cylinder head 2 of an internal combustion engine and an exhaust manifold 3 of the internal combustion engine in such a manner as to connect them together. This cooling adapter 1 is formed of an adapter body 5 as a single object or the like. Exhaust passages 4 for causing an exhaust gas from the cylinder head 2 of the internal combustion engine to flow to the aforementioned exhaust manifold 3 are formed through the adapter body 5. A plurality of (four in this example) of these exhaust passages 4 are provided in parallel with one another in a horizontal direction in accordance with the number of cylinders of the internal combustion engine.

In addition to the aforementioned plurality of the exhaust passages 4, a water jacket 6 for causing to flow a cooling liquid that exchanges heat with an exhaust gas flowing through the exhaust passages 4 is formed inside the adapter body 5. These exhaust passages 4 and the water jacket 6 are defined by an inner wall 7 of the adapter body 5. The water jacket 6 is formed around the entirety of the respective exhaust passages 4 and among the respective exhaust passages 4. Further, an inlet portion 8 configured to cause the cooling liquid to flow into the water jacket 6 and an outlet portion 9 configured to cause the cooling liquid in the water jacket 6 to flow out to the outside are also formed through the adapter body 5.

In the aforementioned cooling adapter 1, the cooling liquid is caused to flow into the water jacket 6 from the inlet portion 8, and the cooling liquid in the water jacket 6 is caused to flow out to the outside from the outlet portion 9. The cooling liquid thereby flows in the water jacket 6 as indicated by arrows in FIG. 2. When the cooling liquid is caused to flow as described above in the water jacket 6 while the exhaust gas of the internal combustion engine flows through the exhaust passages 4 of the cooling adapter 1, heat is exchanged between the cooling liquid and the exhaust gas flowing through the aforementioned exhaust passages 4. Accordingly, the exhaust gas sent from the cylinder head 2 (FIG. 1) of the internal combustion engine to the exhaust manifold 3 via the exhaust passages 4 of the cooling adapter 1 is cooled through the aforementioned heat exchange while passing through the exhaust passages 4. After having been cooled, the exhaust gas flows to the exhaust manifold 3.

Next, a detailed structure around the inlet portion 8 and the outlet portion 9 in the cooling adapter 1 will be described. As shown in FIG. 2, the inlet portion 8 is so provided as to open to the water jacket 6 at a position located below the respective exhaust passages 4 arranged in parallel with one another in the horizontal direction and corresponding to a gap between adjacent ones of the exhaust passages 4 on one side (on the left side in FIG. 2) in the direction in which the exhaust passages 4 are arranged. More specifically, the opening of the inlet portion 8 is so located as to overlap in a vertical direction (in an up-and-down direction in FIG. 2) with that region of the inner wall 7 which is located between the aforementioned adjacent ones of the exhaust passages 4, the inner wall 7 defining a non-end one of both the exhaust passages 4. It should be noted that the opening of the inlet portion 8 also slightly overlaps in the vertical direction with the non-end one of the aforementioned adjacent ones of the exhaust passages 4.

Further, a thick portion 11 for fixing a joint 10 by bolts 12 is formed around the aforementioned inlet portion 8. The aforementioned inlet portion 8 is provided such that the thick portion 11 is so located as to correspond to a space portion between the aforementioned adjacent ones of the exhaust passages 4 in the water jacket 6. The inlet portion 8 communicates with the joint 10 fixed to the aforementioned thick portion 11, and communicates with a region of a cooling liquid circuit other than the cylinder head 2 (FIG. 1) via the joint 10, a hose linked therewith, and the like. The cooling liquid circuit causes the cooling liquid to circulate to cool the internal combustion engine. In addition, the inlet portion 8 is also so provided as to open to the aforementioned water jacket 6 at a position close to the cylinder head 2 in the direction in which the exhaust passages 4 of FIG. 1 extend.

Figure 2:
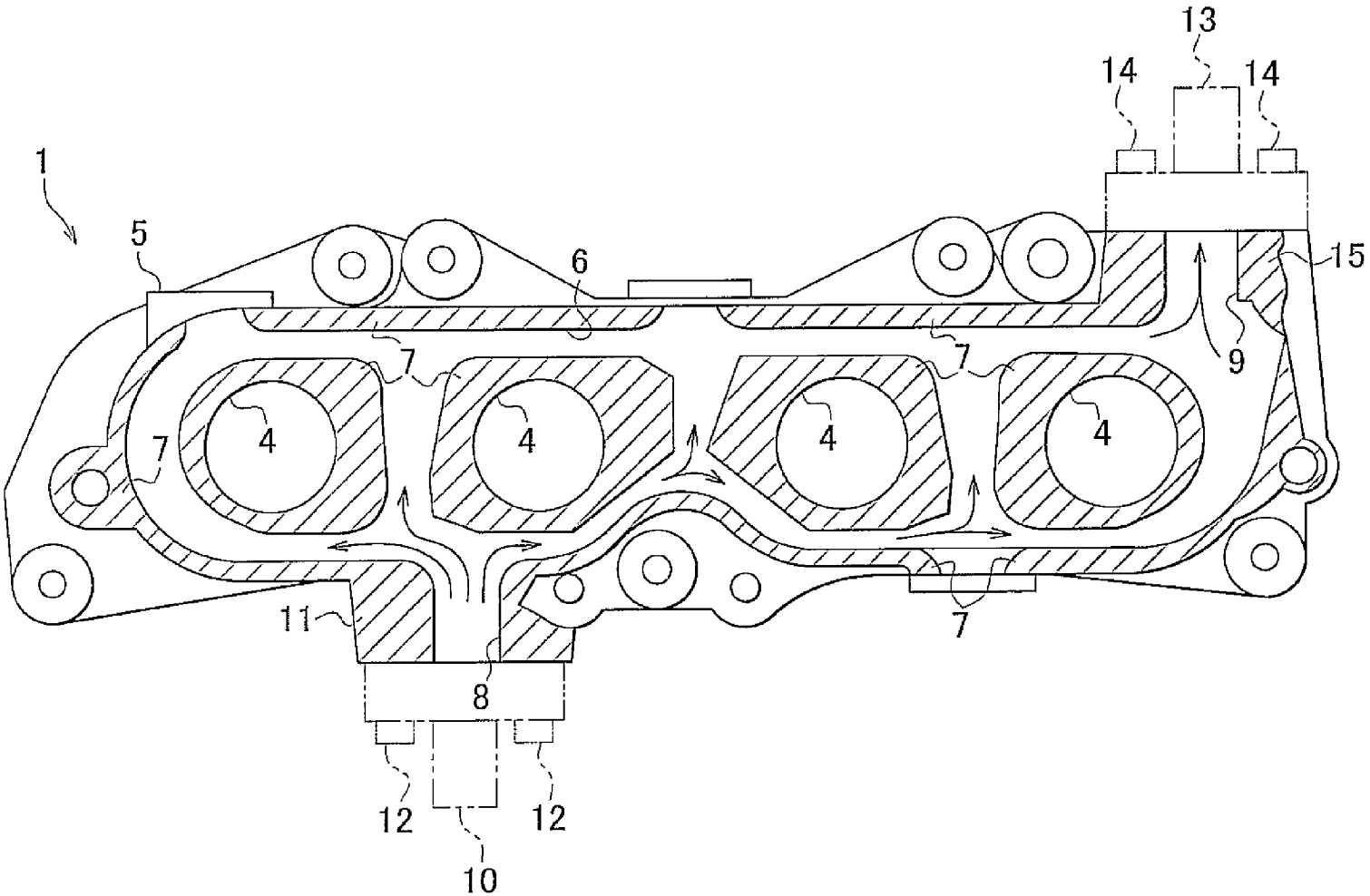
FIG. 2 is a cross-sectional view showing an internal structure of the cooling adapter according to this embodiment of the invention.

As shown in FIG. 2, the outlet portion 9 is so provided as to open to the water jacket 6 at a position located above the respective exhaust passages 4 arranged in parallel with one another in the horizontal direction and on the other side (on the right side in FIG. 2) in the direction in which the exhaust passages 4 are arranged, more specifically, at a more distal end position (more to the right in FIG. 2) than the exhaust passages 4. In addition, the outlet portion 9 also so opens to the aforementioned water jacket 6 as to connect to an uppermost portion of the water jacket 6. It should be noted that a thick portion 15 for fixing a joint 13 by bolts 14 is formed around the outlet portion 9. The outlet portion 9 communicates with the joint 13 fixed to the aforementioned thick portion 15, and communicates with the region of the cooling liquid circuit other than the cylinder head 2 (FIG. 1) via the joint 13, and a hose linked therewith, and the like. The cooling liquid circuit causes the cooling liquid to circulate to cool the internal combustion engine.

Next, the flow of the cooling liquid in the water jacket 6 inside the cooling adapter 1 will be described in detail. As shown in FIG. 2, in the cooling adapter 1, the inlet portion 8 is provided on one side in the direction in which the plurality of the exhaust passages 4 are arranged, and the outlet portion 9 is provided on the other side. Therefore, when the cooling liquid is caused to flow into the water jacket 6 from the inlet portion 8, the cooling liquid is likely to flow from one side toward the other side in the water jacket 6. When the cooling liquid passes around the exhaust passages 4, heat is exchanged between the cooling liquid and the exhaust gas flowing in the exhaust passages 4. After that, the cooling liquid flows out to the outside of the water jacket 6 from the outlet portion 9.

It should be noted herein that when the cooling liquid in the water jacket 6 is likely to flow from one side toward the other side in the direction in which the plurality of the exhaust passages 4 are arranged, the cooling liquid is unlikely to flow into a region between adjacent ones of the exhaust passages 4 in the water jacket 6. As a result, heat is unlikely to be exchanged between the cooling liquid and the exhaust gas in regions among the plurality of the exhaust passages 4 in the water jacket 6. The efficiency of cooling exhaust gas in the cooling adapter 1 may decrease correspondingly.

However, in the cooling adapter 1, the inlet portion 8 is so provided as to open at the position corresponding to the gap between the adjacent ones of the plurality of the exhaust passages 4 at one end in the direction in which the exhaust passages 4 are arranged. Therefore, the low-temperature cooling liquid that has flowed into the water jacket 6 from the inlet portion 8 is likely to flow into the region between the aforementioned adjacent ones of the exhaust passages 4. Thus, in the region between the aforementioned adjacent ones of the exhaust passages 4, heat is not unlikely to be exchanged between the cooling liquid flowing through that region and the exhaust gas flowing in the exhaust passages 4. Accordingly, in the region between the adjacent ones of the exhaust passages 4 in the water jacket 6, heat is unlikely to be exchanged between the cooling liquid and the exhaust gas. The efficiency of cooling exhaust gas in the cooling adapter 1 can be restrained correspondingly from decreasing.

In the meantime, that region of the cylinder head 2 (FIG. 1) of the internal combustion engine on which the cooling adapter 1 is mounted (that region of the cylinder head 2 which is located on an exhaust outlet side) reaches a high temperature due to the heat of exhaust gas and becomes likely to thermally expand. A stress is applied to the cooling adapter 1 as a result of this thermal expansion. The larger this stress becomes, the more thickly the cooling adapter 1 must be formed to be able to cope with the stress. Furthermore, when the amount of the aforementioned thermal expansion in that region of the cylinder head 2 which is located on the exhaust outlet side becomes large, exhaust gas becomes likely to leak from mating faces 2*a*, 1*a* of the cylinder head 2 and the cooling adapter 1 as a result. Therefore, with a view to suppressing the leakage of exhaust gas, it is necessary to take a measure such as the provision of a plurality of gaskets between the mating faces 2*a*, 1*a* or the like.

Figure 3:
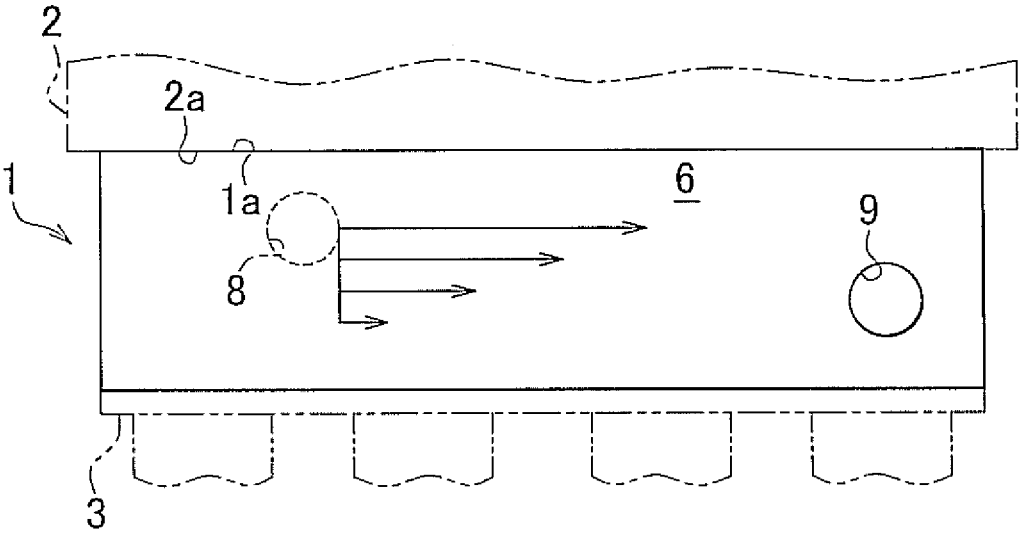
FIG. 3 is a schematic view showing a difference in flow velocity of a cooling liquid in a water jacket of the cooling adapter according to this embodiment of the invention.

In order to cope with these circumferences, the inlet portion 8 of the cooling adapter 1 is so provided as to open to the water jacket 6 at a position close to the cylinder head 2 as shown in FIG. 3. It should be noted that arrows in FIG. 3 represent flow velocities of the cooling liquid flowing from the inlet portion 8 toward the outlet portion 9 in the water jacket 6. It is meant that the flow velocity of the aforementioned cooling liquid increases as the length of the arrows increases. As is apparent from FIG. 3, since the inlet portion 8 opens at the position close to the cylinder head 2, the flow velocity of the aforementioned cooling liquid is highest at the position close to the cylinder head 2, and the flow rate of the cooling liquid is also highest at the position close to the cylinder head 2. As the distance from the inlet portion 8 to the exhaust manifold 3 decreases, the flow velocity of the aforementioned cooling liquid at the position decreases, and the flow rate of the cooling liquid at the position also decreases.

Accordingly, by providing the inlet portion 8 as described above, much of the low-temperature cooling liquid that has flowed into the water jacket 6 from the inlet portion 8 is caused to flow in the vicinity of that region of the cylinder head 2 which is located on the exhaust outlet side in the water jacket 6, and heat in that region can be efficiently absorbed. In other words, that region of the cylinder head 2 which is located on the exhaust outlet side and is likely to thermally expand is efficiently cooled by the cooling liquid that has flowed into the water jacket 6 from the inlet portion 8 of the cooling adapter 1. As a result, the amount of thermal expansion of that region of the cylinder head 2 on which the cooling adapter 1 is mounted can be held small. Thus, the stress applied to the cooling adapter 1 does not increase as a result of the thermal expansion, and there is no need to form the cooling adapter 1 thickly so as to be able to cope with a large stress. Further, the exhaust gas is not likely to leak from the mating faces 2*a*, 1*a* of the cylinder head 2 and the cooling adapter 1 as a result of a large amount of thermal expansion in that region of the cylinder head 2 which is located on the exhaust outlet side. Therefore, there is no need to take a measure such as the provision of a plurality of gaskets between the mating faces 2*a*, 1*a* to suppress the leakage of the exhaust gas either.

According to this embodiment of the invention described above in detail, the following effects are achieved.

(1) The inlet portion 8 configured to cause the cooling liquid to flow into the water jacket 6 of the cooling adapter 1 is so provided as to open at the position close to the cylinder head 2. Therefore, that region of the cylinder head 2 of the internal combustion engine which is located on the exhaust outlet side can be efficiently cooled by the cooling adapter 1, and the amount of thermal expansion in that region can be held small. Further, the aforementioned inlet portion 8 is also so provided as to open at the position corresponding to the gap between the adjacent ones of the plurality of the exhaust passages 4 at one end in the direction in which the exhaust passages 4 are arranged. Therefore, the low-temperature cooling liquid that has flowed into the water jacket 6 from the inlet portion 8 is likely to flow into the region between the aforementioned adjacent ones of the exhaust passages 4 in the water jacket 6. Accordingly, in the region between the aforementioned adjacent ones of the exhaust passages 4, heat is unlikely to be exchanged between the cooling liquid flowing through that region and the exhaust gas flowing in the exhaust passages 4. The efficiency of cooling exhaust gas in the cooling adapter 1 can be restrained correspondingly from decreasing.

(2) In the cooling adapter 1 with the plurality of the exhaust passages 4 provided in parallel with one another, there is a space portion for causing the cooling liquid to flow between the adjacent ones of the exhaust passages 4 in the water jacket 6. Therefore, the geometric moment of inertia of that region of the cooling adapter 1 which corresponds to the space portion is likely to be small, and the amount of deformation by a bending moment in that region is likely to be large. However, in the cooling adapter 1, the inlet portion 8 is provided such that the thick portion 11 formed around the inlet portion 8 to fix the joint 10 is so located as to correspond to the aforementioned space portion. Thus, the geometric moment of inertia of that region of the cooling adapter 1 which corresponds to the aforementioned space portion is large, and the amount of deformation by a bending moment in that region can be held small.

(3) In the cooling adapter 1, the air that has flowed into the water jacket 6 is likely to accumulate in the upper portion inside the water jacket 6. It is preferable to swiftly discharge this air to the outside from the outlet portion 9, from the standpoint of efficiently exchanging heat between the cooling liquid flowing through the water jacket 6 and the exhaust gas passing through the exhaust passages 4. In this respect, in the cooling adapter 1, the cooling liquid flows into the water jacket 6 from the inlet portion 8 provided below the exhaust passages 4, and the cooling liquid in the water jacket 6 flows out from the outlet portion 9 that is provided above the exhaust passages 4 and so opens as to connect to the uppermost portion of the water jacket 6. Thus, even when air accumulates in the upper portion inside the water jacket 6 as described above, it is possible to swiftly discharge the air to the outside from the outlet portion 9 through the flow of the aforementioned cooling liquid.

(4) The aforementioned outlet portion 9 is so provided as to open on a more distal end side (on the right side) than that one of the plurality of the exhaust passages 4 which is located at the other end (at the right end in FIG. 2) in the direction in which the exhaust passages 4 are arranged, and the cooling liquid in the water jacket 6 can be discharged to the outside from the outlet portion 9. Accordingly, the flow of the cooling liquid to the outside can be formed in that region of the upper portion in the water jacket 6 which corresponds to the aforementioned end side, namely, in a region where air is likely to accumulate. As a result, air can be restrained from accumulating in that region.

(5) In the cooling adapter 1, the exhaust passages 4, the water jacket 6, the inlet portion 8, and the outlet portion 9 are formed through the adapter body 5 as a single object. If an adapter body formed of a plurality of objects combined with one another is adopted and the exhaust passages 4, the water jacket 6, the inlet portion 8, and the outlet portion 9 are formed through the adapter body, the following problem arises. That is, the leakage of exhaust gas from the exhaust passages 4 or the leakage of water from the water jacket 6 may occur on borders among the plurality of the objects constituting the adapter body. It is necessary to give consideration to a sealing material for suppressing such leakage and the like. However, in the cooling adapter 1, the exhaust passages 4, the water jacket 6, the inlet portion 8, and the outlet portion 9 are formed through the adapter body 5 as a single object. Therefore, the aforementioned problem does not arise.

Figure 4:
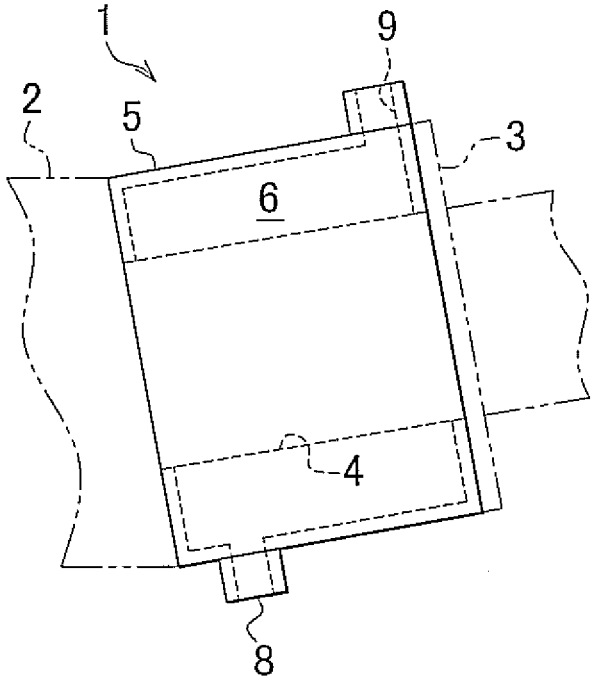
FIG. 4 is a schematic view showing another example of a mode in which the cooling adapter according to this embodiment of the invention is mounted.

It should be noted that the foregoing embodiment of the invention can also be modified, for example, as follows. As shown in FIG. 4, the cooling adapter 1 may be mounted in such an inclined state that the exhaust manifold 3 side of the exhaust passages 4 is directed upward with respect to the cylinder head 2 of the internal combustion engine. In the case where this mounting structure is adopted, when the outlet portion 9 is so opened to the water jacket 6 as to connect to the uppermost portion of the water jacket 6, the outlet portion 9 opens to the water jacket 6 at the position close to the exhaust manifold 3 in the direction in which the exhaust passages 4 extend. It should be noted herein that when the aforementioned mounting structure of the water jacket 6 is adopted, the air that has entered the water jacket 6 is likely to accumulate in the region on the exhaust manifold 3 side in the upper portion inside the water jacket 6. However, the outlet portion 9 is so provided as to open at the position above the cooling adapter 1 (above the exhaust passages 4) and close to the exhaust manifold 3. Therefore, the air that has accumulated as described above can also be swiftly discharged to the outside from the outlet portion 9 through the flow of the cooling liquid in the water jacket 6.

The position of the outlet portion 9 in the direction in which the plurality of the exhaust passages 4 are arranged can be appropriately changed. For example, the aforementioned outlet portion 9 may be so provided as to open to the water jacket 6 at a position between that one of the plurality of the exhaust passages 4 which is located at the other end (at the right end in FIG. 2) in the direction in which the exhaust passages 4 are arranged and the exhaust passage 4 adjacent thereto.

It is not absolutely required that the outlet portion 9 be so provided as to open at the position close to the exhaust manifold 3. For example, the outlet portion 9 can also be so provided as to open at the position close to the cylinder head 2.

Figure 5:
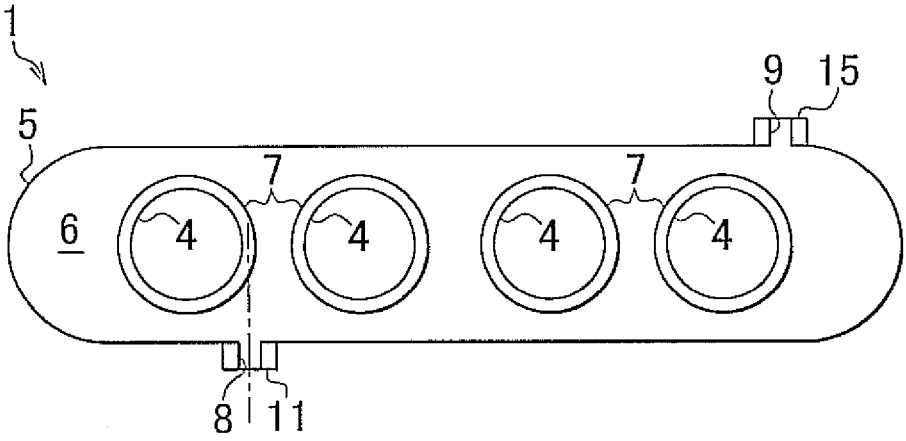
FIG. 5 is a schematic view showing another example of a mode in which an inlet portion and a thick portion are formed for the cooling adapter according to this embodiment of the invention.

The inlet portion 8 may be provided at such a position that the opening thereof overlaps in the vertical direction (in the up-and-down direction in the drawing) with that region of the inner wall 7 which is located between the adjacent ones of the exhaust passages 4 at one end in the direction in which the plurality of the exhaust passages 4 are arranged. The inner wall 7 defines that one of both the exhaust passages 4 which is located on the end side. In this case as well, it is preferable that the inlet portion 8 be provided such that the thick portion 11 is so located as to correspond to the space portion between the adjacent ones of the plurality of the exhaust passages 4 at one end in the direction in which the exhaust passages 4 are arranged in the water jacket 6. FIG. 5 shows an example of a case where the inlet portion 8 is provided as described above.

Figure 6:
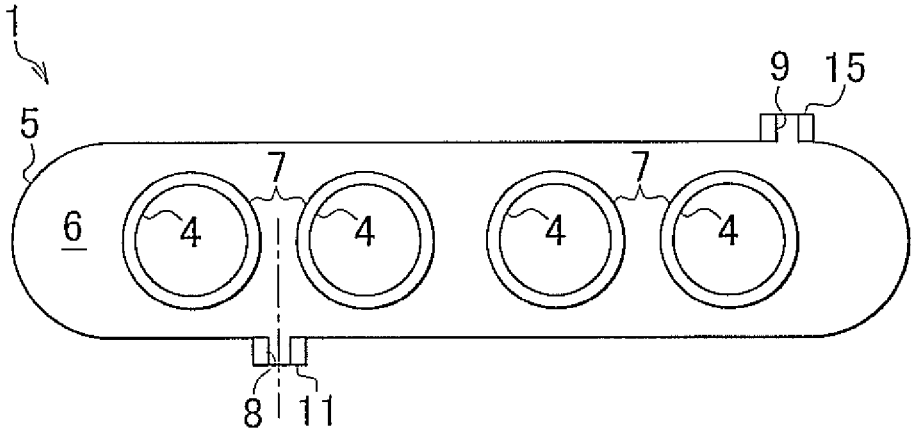
FIG. 6 is a schematic view showing still another example of a mode in which the inlet portion and the thick portion are formed for the cooling adapter according to this embodiment of the invention.

The inlet portion 8 may be provided such that the opening thereof is so located as to correspond to the space portion between the adjacent ones of the plurality of the exhaust passages 4 at one end in the direction in which the exhaust passages 4 are arranged in the water jacket 6. FIG. 6 shows an example of a case where the inlet portion 8 is thus provided.

The inlet portion 8 can be so changed in position in the direction in which the respective exhaust passages 4 are arranged as to open at the position corresponding to a region between arbitrary adjacent ones of the respective exhaust passages 4.

The number of the exhaust passages 4 in the cooling adapter 1 may be appropriately changed to an arbitrary number, for example, 2, 3, 4, 5, 6 or the like, in accordance with the number of cylinders of the internal combustion engine, the arrangement of the cylinders, and the like. The positional relationship between the inlet portion 8 and the outlet portion 9 may be appropriately changed. For example, both the inlet portion 8 and the outlet portion 9 may be provided below or above the respective exhaust passages 4. Further, the inlet portion 8 may be provided above the respective exhaust passages 4, and the outlet portion 9 may be provided below the respective exhaust passages 4.

While the invention has been described with reference to example embodiments thereof, it is to be understood that the invention is not limited to the example described embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the scope of the invention.

What is claimed is:

1. A cooling adapter provided between a cylinder head of an internal combustion engine and an exhaust pipe of the internal combustion engine in such a manner as to connect the cylinder head and the exhaust pipe to each other, comprising:

a plurality of exhaust passages provided in parallel with one another to cause an exhaust gas from the cylinder head to flow to the exhaust pipe;

a water jacket formed around an entirety of the respective exhaust passages and among the respective exhaust passages to cause a cooling liquid to flow to exchange heat with an exhaust gas flowing through the plurality of the exhaust passages;

a single inlet portion configured to cause the cooling liquid to flow into the water jacket; and an outlet portion configured to cause the cooling liquid to flow out from inside the water jacket, wherein the inlet portion is so provided as to open to the water jacket at a position close to the cylinder head and the inlet portion is so provided as to open to the water jacket at a position offset from one of the exhaust passages and the inlet portion is so provided as to open at a position corresponding to a gap between a first end exhaust passage and an adjacent second exhaust passage of the plurality of exhaust passages at one end in a direction in which the plurality of the exhaust passages are arranged, a third end exhaust passage of the plurality of exhaust passages positioned opposite of the first end exhaust passage and the second exhaust passages;

the outlet portion is so provided as to open at a position close to the third end exhaust passage located at the other end in the direction in which the plurality of the exhaust passages are arranged.

2. The cooling adapter according to claim 1, wherein the inlet portion has a thick portion formed therearound for fixing a joint, and the inlet portion is provided such that the thick portion is so located as to correspond to a space portion between the adjacent exhaust passages in the water jacket.

3. The cooling adapter according to claim 1, wherein the outlet portion has a thick portion formed therearound for fixing a joint.

4. The cooling adapter according to claim 1, wherein the inlet portion is provided at such a position as to overlap in a vertical direction with a region located between the adjacent exhaust passages.

5. The cooling adapter according to claim 1, wherein the plurality of the exhaust passages are provided in parallel with one another in a horizontal direction, the inlet portion is provided below the exhaust passages, and the outlet portion is provided above the exhaust passages and so opens as to connect to an uppermost portion of the water jacket.

6. The cooling adapter according to claim 1, wherein the outlet portion is so provided as to open to the water jacket on a more distal end side than that one of the plurality of the exhaust passages which is located at the other end in the direction in which the exhaust passages are arranged.

7. The cooling adapter according to claim 1 that is mounted on the cylinder head in such an inclined state that the exhaust pipe is directed upward with respect to the plurality of the exhaust passages.

* * * * *